US009945515B2

(12) United States Patent
Nakano

(10) Patent No.: US 9,945,515 B2
(45) Date of Patent: Apr. 17, 2018

(54) ABOVE-GROUND LOW-TEMPERATURE TANK

(71) Applicant: IHI Corporation, Tokyo (JP)

(72) Inventor: Takuya Nakano, Tokyo (JP)

(73) Assignee: IHI CORPORATION, Tokyo (JP)

( * ) Notice: Subject to any disclaimer, the term of this patent is extended or adjusted under 35 U.S.C. 154(b) by 261 days.

(21) Appl. No.: 15/007,453

(22) Filed: Jan. 27, 2016

(65) Prior Publication Data

US 2016/0138758 A1 May 19, 2016

Related U.S. Application Data

(63) Continuation of application No. PCT/JP2014/071991, filed on Aug. 22, 2014.

(30) Foreign Application Priority Data

Aug. 23, 2013 (JP) ..... 2013-173598

(51) Int. Cl.
*B65D 90/02* (2006.01)
*F17C 3/02* (2006.01)

(52) U.S. Cl.
CPC ..... *F17C 3/022* (2013.01); *F17C 2201/0109* (2013.01); *F17C 2201/0119* (2013.01);
(Continued)

(58) Field of Classification Search
CPC .... F17C 3/00; F17C 3/02; F17C 3/022; F17C 3/04; F17C 2203/0678; F17C 2203/0636;
(Continued)

(56) References Cited

U.S. PATENT DOCUMENTS 4,366,654 A * 1/1983 Bomhard ..... F17C 3/022 52/223.2
8,783,501 B2 * 7/2014 Mookerjee ..... F17C 3/022 137/264

(Continued)

FOREIGN PATENT DOCUMENTS

JP 57-42299 U 3/1982
JP 7-285593 A 10/1995

(Continued)

OTHER PUBLICATIONS

International Search Report dated Nov. 18, 2014 in PCT/JP2014/071991 (4pages).

*Primary Examiner* — Steven A. Reynolds
*Assistant Examiner* — Javier A Pagan
(74) *Attorney, Agent, or Firm* — Rothwell, Figg, Ernst & Manbeck, P.C.

(57) ABSTRACT

An above-ground low-temperature tank includes a metal inner tank which stores low-temperature liquefied gas, and an outer tank which includes a concrete outer wall surrounding the inner tank. A hole portion which has a preset depth from a bottom surface of the inner tank is formed on a bottom portion of the inner tank, and a metal pit main body having a cylindrical bottomed accommodating portion is provided in a state where the accommodating portion is accommodated in the hole portion. A reinforcing body which supports at least an outer circumferential edge portion of a bottom surface of the pit main body is provided on the bottom surface side of the pit main body in the hole portion. A cold insulation material is provided below the reinforcing body.

8 Claims, 2 Drawing Sheets

(52) U.S. Cl.
CPC .. *F17C 2201/032* (2013.01); *F17C 2201/052* (2013.01); *F17C 2203/035* (2013.01); *F17C 2203/0341* (2013.01); *F17C 2203/0629* (2013.01); *F17C 2203/0636* (2013.01); *F17C 2203/0678* (2013.01); *F17C 2221/033* (2013.01); *F17C 2221/035* (2013.01); *F17C 2223/0153* (2013.01); *F17C 2223/0161* (2013.01); *F17C 2223/047* (2013.01); *F17C 2225/0153* (2013.01); *F17C 2225/0161* (2013.01); *F17C 2227/0142* (2013.01); *F17C 2227/0178* (2013.01); *F17C 2260/033* (2013.01); *F17C 2270/0134* (2013.01)

(58) Field of Classification Search
CPC ..... F17C 2203/0634; F17C 2221/033; F17C 2221/035; F17C 2260/033; F17C 2270/0134; F17C 2227/0178; F17C 2227/0128; F17C 2227/0135
USPC ..... 220/565
See application file for complete search history.

(56) References Cited

U.S. PATENT DOCUMENTS

| | | | | |
|---|---|---|---|---|
| 2013/0200077 | A1* | 8/2013 | Nishizaki | F17C 3/022 220/560.1 |
| 2015/0377415 | A1 | 12/2015 | Sugiura et al. | |
| 2015/0377550 | A1 | 12/2015 | Sakai | |

FOREIGN PATENT DOCUMENTS

| | | | |
|---|---|---|---|
| JP | 2000-346294 | A | 12/2000 |
| JP | 2001-108198 | A | 4/2001 |
| JP | 2003-278998 | A | 10/2003 |
| JP | 3978892 | B2 | 9/2007 |
| JP | 4014743 | B2 | 11/2007 |
| JP | 2014-194256 | A | 10/2014 |

* cited by examiner

ABOVE-GROUND LOW-TEMPERATURE TANK

This application is a Continuation of International Application No. PCT/JP2014/071991, filed on Aug. 22, 2014, claiming priority based on Japanese Patent Application No. 2013-173598, filed on Aug. 23, 2013, the content of which is incorporated herein by reference in their entirety.

BACKGROUND

Technical Field

Embodiments described herein relates to an above-ground low-temperature tank.

Description of Related Art

In the related art, for example, as a low-temperature tank which stores low-temperature liquefied gas such as Liquefied Natural Gas (LNG), a full containment double-shell tank is used which includes a metal inner tank which stores low-temperature liquefied gas and an outer tank which includes a concrete outer wall surrounding the inner tank. In the low-temperature tank, in order to discharge the stored liquefied gas to the outside, a liquid discharging pump is installed in a pump well in the tank.

The liquid discharging pump is accommodated in a lower end of a well which penetrates a roof in the tank, and is configured to suction the liquefied gas from the lower end of the well.

In this pump, for example, if a height of a liquid surface is positioned 1 m to 3 m above a suction port, swirl and/or bubbles interfere with the suction of the pump. Accordingly, the pump cannot discharge the liquid.

Therefore, liquid corresponding to a height, which is obtained by adding a height from a bottom surface to the suction port to the height from the suction port to the liquid surface, cannot be discharged from the tank. As a result, an effective storage amount of the tank is greatly decreased.

In order to cope with this, for example, it is considered that a pump pit for a tank is formed. The pump pit for a tank is suggested in a under-ground and membrane type low-temperature tank (for example, refer to Patent Document 1, Patent Document 2, and Patent Document 3).

In the under-ground tank, since a portion protruding from the ground is small, limitation with respect to a height (depth) of a tank is decreased. Accordingly, by sufficiently increasing a depth of a hole for burying a tank, it is possible to construct a cold insulation layer, which is disposed between a foundation slab and an inner tank, with a sufficient thickness. On the other hand, in an above-ground tank, due to scenery or the like, the height of a tank is limited. Accordingly, in order to sufficiently secure an effective storage amount of a tank, a thickness of a cold insulation layer disposed between a foundation slab and an inner tank is limited.

[Patent Document 1] Japanese Patent No. 3978892

[Patent Document 2] Japanese Patent No. 4014743

[Patent Document 3] Japanese Unexamined Patent Application, First Publication No. 2003-278998

As described above, in the above-ground tank, particularly, the thickness of the cold insulation layer disposed between the foundation slab and the inner tank is limited. Accordingly, it is difficult to provide the pump pit for a tank.

That is, when the pump pit is provided in the above-ground tank, it is assumed that a hole portion is formed on a bottom surface of the tank, and a metal cylindrical bottomed pit main body is provided in the hole portion. However, particularly, a linear load tends to concentrate on a corner portion of a bottom portion in the pit main body. Accordingly, the linear load is transmitted to a portion of a bottom surface of the tank which receives the bottom portion of the pit main body, and large stress occurs. Since the cold insulation layer is formed of cellular glass or the like, cracks or the like occur on the cold insulation layer due to the stress, and cold insulation performance is decreased.

As described above, in the under-ground tank, it is possible to construct the cold insulation layer, which is disposed between the foundation slab and the inner tank, with a sufficient thickness. Accordingly, a decrease in the cold insulation performance because of the stress generated due to the linear load does not occur. However, in the above-ground tank, since the thickness of the cold insulation layer is limited, a decrease in the cold insulation performance due to the stress greatly damages the performance of the low-temperature tank itself.

The present disclosure is made in consideration of the above-described circumstances, and an object thereof is to provide an above-ground low-temperature tank capable of providing a pump pit while preventing a decrease in cold insulation performance.

SUMMARY

An above-ground low-temperature tank in accordance with the first aspect of the present disclosure includes a metal inner tank which stores low-temperature liquefied gas; and an outer tank which includes a concrete outer wall surrounding the inner tank.

Furthermore, a hole portion which has a preset depth from a bottom surface of the inner tank is formed on a bottom portion of the inner tank, and a metal pit main body having a cylindrical bottomed accommodating portion is provided in a state where the accommodating portion is accommodated in the hole portion, a reinforcing body which supports at least an outer circumferential edge portion of a bottom surface of the pit main body is provided on the bottom surface side of the pit main body in the hole portion, and a cold insulation material is provided below the reinforcing body. In addition, for example, the reinforcing body is made of concrete.

In the above-ground low-temperature tank in accordance with the second aspect of the present disclosure, preferably, compressed glass wool is disposed outside a side peripheral surface of the pit main body in the hole portion.

In the above-ground low-temperature tank in accordance with the third aspect of the present disclosure, the reinforcing body may be annularly formed to support the outer circumferential edge portion of the bottom surface of the pit main body, and the cold insulation material may be provided inside the annular reinforcing body.

In the above-ground low-temperature tank of the present disclosure, the concrete reinforcing body which supports at least the outer circumferential edge portion of the bottom surface of the pit main body is provided on the bottom surface side of the pit main body, and the cold insulation material is provided below the reinforcing body. Accordingly, particularly, a linear load, which is intensively applied to a corner portion (outer circumferential edge portion) of the bottom portion of the pit main body, can be received by the reinforcing body, and it is possible to prevent the load from being transmitted to the cold insulation material which is disposed below the reinforcing body. Accordingly, it is possible to prevent occurrence of cracks or the like on the cold insulation layer because of stress generated due to transmission of the liner load, and a decrease in cold insulation performance due to the cracks or the like. That is, it is possible to provide a pump pit while preventing a decrease in cold insulation performance.

DETAILED DESCRIPTION OF THE DISCLOSURE

Figure 1:
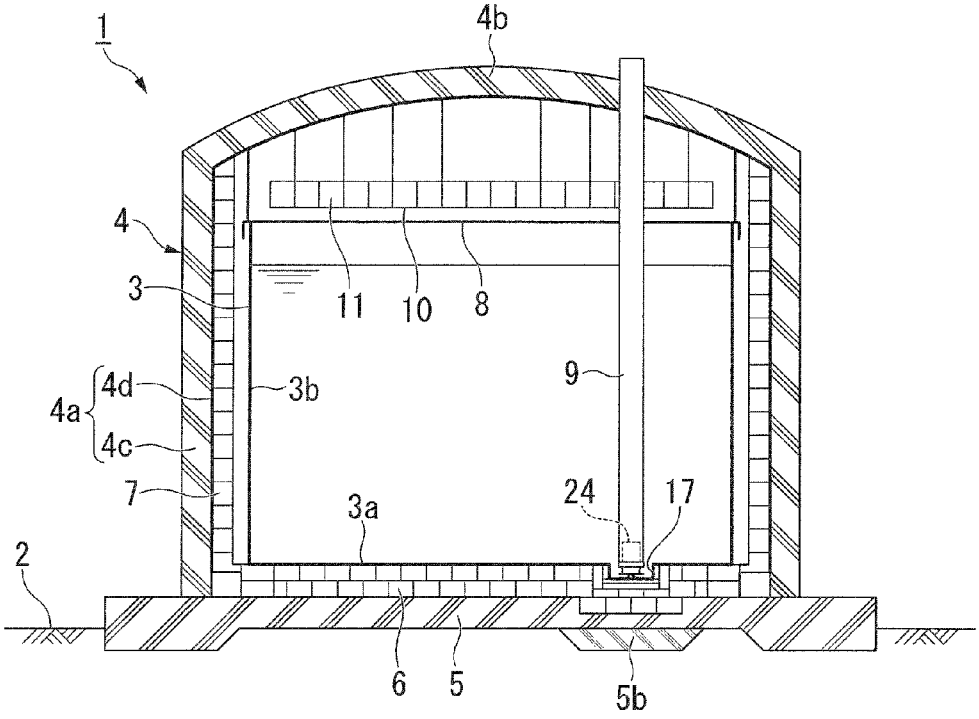
FIG. 1 is a side sectional view showing a schematic configuration of an embodiment of an above-ground low-temperature tank according to the present disclosure.

Hereinafter, with reference to the drawings, an above-ground low-temperature tank of the present disclosure will be described in detail. In the drawings below, in order to show each member in a recognizable size, a scale of each member is appropriately changed.

FIG. 1 is a side sectional view showing a schematic configuration of an embodiment of an above-ground low-temperature tank according to the present disclosure, and a reference numeral 1 in FIG. 1 indicates an above-ground low-temperature tank (hereinafter, referred to as a low-temperature tank). The low-temperature tank 1 is an above-ground low-temperature tank which stores low-temperature liquefied gas such as LNG LPG, or liquefied ethylene. In the present embodiment, LNG is stored in the low-temperature tank.

The low-temperature tank 1 is provided on the ground 2, and has a double-shell structure which is configured to include a metal inner tank 3 which stores low-temperature liquefied gas (LNG) and an outer tank 4 which surrounds the periphery of the inner tank 3 and covers the inner tank 3. That is, a concrete foundation slab (base) 5 is fixed onto the ground 2, and a cylindrical outer tank (tank) 4 is installed on the foundation slab 5. A tank bottom portion 6 is formed on the foundation slab 5, and the cylindrical inner tank 3 is installed on the tank bottom portion 6.

The inner tank 3 is formed of a steel plate or the like and includes a bottom plate 3*a* and a cylindrical side wall 3*b*. The inner tank 3 is disposed on the tank bottom portion 6 and installed inside the outer tank 4 via a cold insulation layer 7. The outer tank 4 includes a side wall portion 4*a* and a roof portion 4*b*, and the side wall portion 4*a* is formed of a concrete outer wall 4*c* which surrounds the side wall 3*b* of the inner tank 3 and an outer tank main body 4*d* which is formed of a steel plate provided on an inner circumferential surface of the concrete outer wall 4*c*. The low-temperature tank 1 having the above-described configuration is a full containment double-shell tank.

An upper opening portion of the inner tank 3 is covered by a cover 8. Accordingly, the cover 8 becomes a roof portion of the inner tank 3. For example, the cover 8 is formed of a thin aluminum plate. The cover 8 does not airtightly seal the upper opening portion of the inner tank 3 and only covers the upper opening portion. A pump well 9 configured to discharge low-temperature liquefied gas from the inside of the inner tank 3 to the outside is provided so as to penetrate the cover 8 covering the inner tank 3 and the roof portion 4*b* of the outer tank 4. A supply pipe (not shown) for supplying low-temperature liquefied gas from the outside into the inner tank 3 is also provided so as to penetrate the cover 8 and the roof portion 4*b*.

A gap is formed between the side wall 3*b* of the inner tank 3 and the side wall portion 4*a* of the outer tank 4, and as described above, the cold insulation layer 7 is provided in the gap. For example, the cold insulation layer 7 is formed of polyurethane foam (PUF), granulated perlite, or the like.

A suspended deck 10 is disposed on the cover 8, and a cold insulation layer 11 formed, for example, of glass wool is laid on the suspended deck 10.

Figure 2:
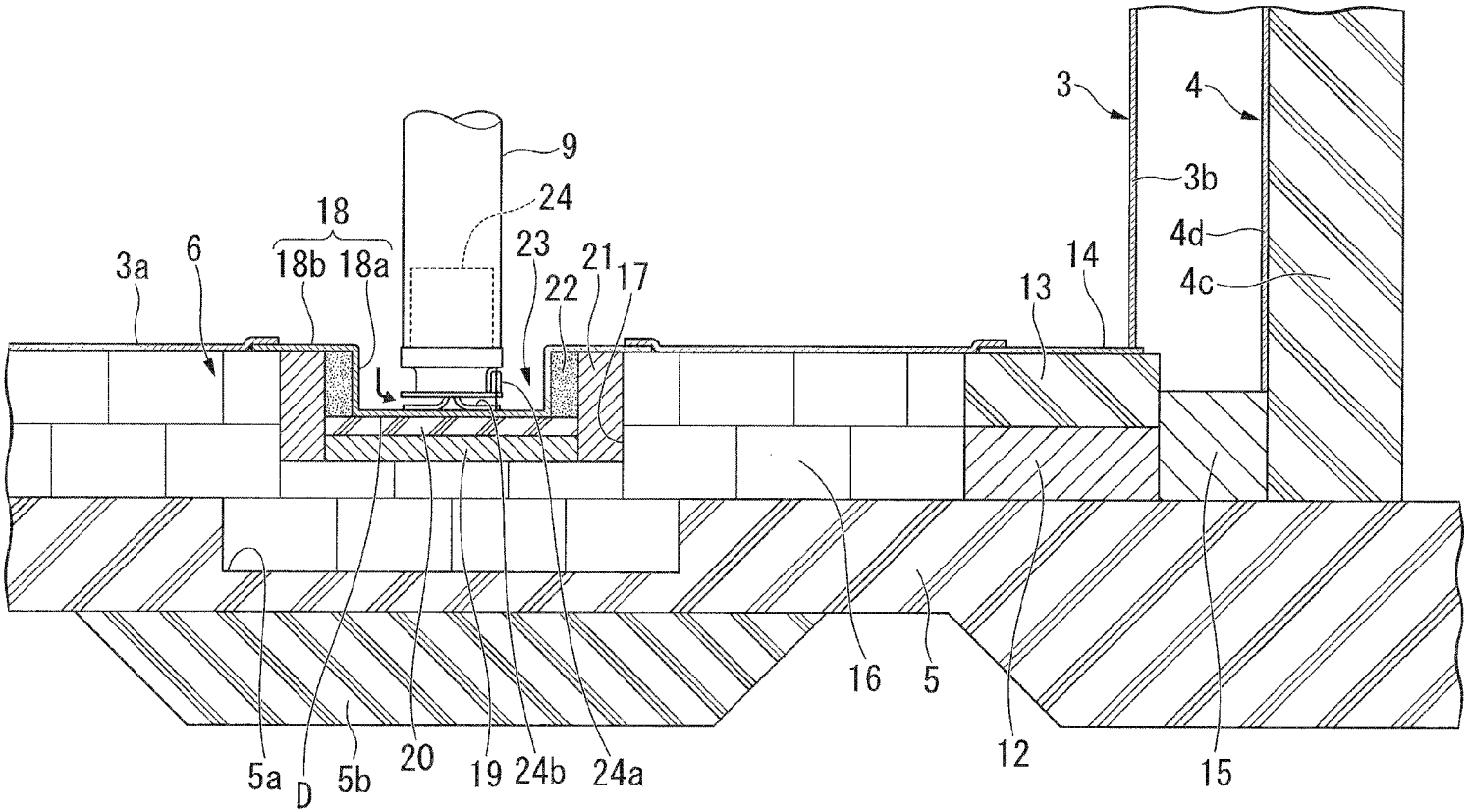
FIG. 2 is a side sectional view in which a foundation slab and a tank bottom portion of FIG. 1 are enlarged.

As shown in an enlarged side sectional view of FIG. 2, the lower side of the bottom plate 3*a* of the inner tank 3 is configured of the foundation slab 5 and the tank bottom portion 6 formed on the foundation slab 5. A foundation slab hole portion 5*a* is formed on the foundation slab 5 at a position corresponding to a formation position of a pump pit described below. The foundation slab hole portion 5*a* is formed in a preset depth. A reinforcing foundation slab 5*b* is provided at a position of the lower side of the foundation slab hole portion 5*a*. The reinforcing foundation slab 5*b* is formed so as to be slightly larger than the foundation slab hole portion 5*a* in a plan view, and reinforces a portion of the foundation slab 5 which is thinned by forming the foundation slab hole portion 5*a*.

In a portion supporting the side wall 3*b* of the inner tank 3, that is, in an annular portion of the inner tank 3, a perlite concrete 12 having a cold insulation function and a structural lightweight concrete 13 are laminated in this order, and the tank bottom portion 6 is formed. An annular plate 14 is disposed on the lightweight concrete 13, and the side wall 3*b* of the inner tank 3 is installed on the annular plate 14.

A cold insulation material 15 formed of cellular glass or the like is provided between the annular portion and the outer tank 4.

A cold insulation material 16 formed of cellular glass or the like is also provided in a center side of the inner tank 3 from the annular portion. For example, the cold insulation material 16 is laminated in two layers in order to obtain set cold insulation performance. The cold insulation material 16 is also provided in the above-described foundation slab hole portion 5*a*.

The bottom plate 3*a* of the inner tank is laid on the cold insulation material 16, the bottom plate 3*a* and the annular plate 14 are connected to each other by welding or the like, and the inner tank 3 is formed. In the present embodiment, a cylindrical hole portion 17 is formed on the bottom portion of the inner tank 3 having the above-described configuration. In order to form the pump pit, the hole portion 17 is formed on the cold insulation material 16, which is positioned on the foundation slab hole portion 5*a*, in a preset depth.

A reference numeral 18 indicates a metal pit main body. Specifically, the pit main body 18 is formed of a steel plate which is the same material as that of the bottom plate 3*a* of the inner tank 3.

The pit main body 18 is configured of a cylindrical bottomed accommodating portion 18*a*, and a flange portion 18*b* which is formed on an upper opening portion of the accommodating portion 18*a*, and the accommodating portion 18*a* is accommodated in the hole portion 17 from above. A height of the accommodating portion 18*a* is set so as to be sufficiently shallower (lower) than a depth of the hole portion 17, and an outer diameter of the accommodating portion 18*a* is set so as to be sufficiently smaller than an inner diameter of the hole portion 17. A diameter of the flange portion 18*b* is greater than the inner diameter of the hole portion 17.

In the pit main body 18 having the above-described configuration, the flange portion 18*b* is suspended on the periphery portion of the opening of the hole portion 17. Accordingly, the accommodating portion 18*a* is accommodated in the hole portion 17 in a state where the accommodating portion 18*a* is hung in the hole portion 17. That is, the accommodating portion 18*a* of the pit main body 18 is accommodated in the hole portion 17 so that a gap is provided between the accommodating portion 18*a* and the cold insulation material 16 forming the hole portion 17.

In the gap between the accommodating portion 18*a* and the cold insulation material 16, a cold insulation material is provided so as to fill the gap. That is, a cold insulation layer (cold insulation material) 19 formed of cellular glass or polyurethane foam (PUF) is disposed immediately above the cold insulation material 16 forming the hole portion 17 and below the accommodating portion 18*a*.

A concrete reinforcing body 20 which comes into contact with a bottom surface D of the accommodating portion 18*a* is disposed between the cold insulation layer 19 and the bottom surface D of the pit main body 18 (more precisely, the bottom surface D of the accommodating portion 18*a*), that is, on the bottom surface D side of the accommodating portion 18*a* in the hole portion 17. For example, the reinforcing body 20 is a disk-shaped member or a square plate-shape member having a thickness of approximately 10 cm to 20 cm, and in a plan view, the reinforcing body 20 is formed so as to be slightly larger than the bottom surface D of the accommodating portion 18*a*.

Accordingly, the reinforcing body 20 supports the accommodating portion 18*a*, and particularly, supports an outer circumferential edge portion of the bottom surface D of the accommodating portion 18*a*. Therefore, the reinforcing body 20 can receive a linear load which is intensively applied to a corner portion between the bottom plate and the side plate of the accommodating portion 18*a*. Accordingly, it is possible to prevent the linear load which is intensively applied to the corner portion of the accommodating portion 18*a* from being transmitted to the cold insulation layer 19, and as a result, it is possible to prevent occurrence of stress due to the linear load in the cold insulation layer 19 or the cold insulation material 16 disposed below the cold insulation layer 19.

Here, as the reinforcing body 20, in order to receive the linear load and prevent the linear load from being transmitted to the cold insulation layer 19 disposed below the reinforcing body 20, an RC concrete (reinforced concrete) which is reinforced by a reinforcing bar is suitably used. Since the high-strength RC concrete is used, the reinforcing body 20 can sufficiently endure the linear load even when the reinforcing body 20 has a relatively thin thickness (for example, approximately 10 cm to 20 cm). The RC concrete has little heat insulation performance, and does not have a function as a cold insulation material. Accordingly, for example, the thickness of the reinforcing body 20 is limited to a thin thickness such as approximately 10 cm to 20 cm, and the cold insulation layer 19 is formed below the reinforcing body 20. That is, by disposing the cold insulation layer 19, a decrease in a heat insulation property (cold insulation property) generated due to disposition of the reinforcing body 20 is compensated for. However, when the thickness of the cold insulation layer 19 cannot be sufficiently obtained in the design, a heat insulating concrete or the like may be used as the reinforcing body 20 in order to prevent a decrease in the heat insulation property (cold insulation property).

A cold insulation layer 21 formed of cellular glass or polyurethane foam (PUF) is disposed on the inner circumferential surface of the cold insulation material 16 forming the hole portion 17 and on the side of the accommodating portion 18*a*. The cold insulation layer 21 may be disposed according to the same process as the cold insulation layer 19. Compressed glass wool 22 serving as a cold insulation material is disposed between the cold insulation layer 21 and the side peripheral surface of the accommodating portion 18*a*, that is, outside the side peripheral surface of the pit main body 18. The glass wool 22 absorbs displacement of the pit main body 18 generated due to heat shrinkage of the bottom plate 3*a* of the inner tank 3. Accordingly, the glass wool 22 always fills the gap between the side peripheral surface of the pit main body 18 and the cold insulation material 16, and it is possible to favorably exert a cold insulation function.

As described above, the flange portion 18*b* of the pit main body 18 is suspended on the periphery portion of the opening of the hole portion 17, and in this state, the flange portion 18*b* is welded to the bottom plate 3*a* of the inner tank 3 so as to be connected to the bottom plate 3*a* in a liquid-tight manner. Accordingly, the pit main body 18 also substantially configures the bottom surface of the inner tank 3. In addition, a pump pit 23 is formed by a concave portion (hole portion) which is formed by the accommodating portion 18*a* of the pit main body 18.

A lower end portion of the pump well 9 is inserted into the pump pit 23. A pump 24 is disposed on the lower end portion of the pump well 9. The pump 24 includes a cover portion 24*b* which is opened and closed by operating a driving portion 24*a* and forms a liquid suction portion. Accordingly, the pump 24 suctions a liquid as shown by an arrow by opening the cover portion 24*b* and discharges a liquid outside the tank through the pump well 9.

In the low-temperature tank 1, the concrete reinforcing body 20 configured to support the bottom surface D is provided on the bottom surface D side of the pit main body 18, and the cold insulation layer 19 (cold insulation material) is provided below the reinforcing body 20. Accordingly, particularly, since the linear load which is intensively applied to the corner portion (outer circumferential edge portion) of the bottom portion of the pit main body 18 can be received by the reinforcing body 20, it is possible to prevent the linear load from being transmitted to the cold insulation layer 19 which is provided below the reinforcing body 20. Accordingly, it is possible to prevent occurrence of cracks in the cold insulation layer 19 because of stress generated due to transmission of the liner load, and a decrease in cold insulation performance due to the cracks or the like. That is, in the low-temperature tank 1, it is possible to provide the pump pit 23 while preventing a decrease in cold insulation performance and to sufficiently secure an effective storage amount of a tank.

Since the compressed glass wool 22 is disposed outside the side peripheral surface of the pit main body 18 in the hole portion 17, even when the pit main body 18 is displaced by heat shrinkage of the bottom plate 3*a* when low-temperature liquefied gas enters the inner tank 3 or the like, the glass wool 22 absorbs the displacement. Accordingly, the glass wool 22 always fills the gap between the side peripheral surface of the pit main body 18 and the cold insulation material 16, and it is possible to favorably exert a cold insulation function.

Therefore, it is possible to prevent a decrease in cold insulation performance of the low-temperature tank 1 generated due to the shape of the pump pit 23.

The present disclosure is not limited to the above-described embodiment, and various modifications may be applied within a scope which does not depart from the scope of the present disclosure.

For example, in the above-described embodiment, the reinforcing body 20 uses a disk-shaped member or a square plate-shape member. However, the reinforcing body 20 of the present disclosure may have any shape as long as it can support at least the outer circumferential edge portion of the bottom surface D of the pit main body 18. Accordingly, for example, the reinforcing body 20 may be formed in an annular shape or the like so as to support the outer circumferential edge portion of the bottom surface D of the pit main body 18. In this case, preferably, a cold insulation material is provided inside (in the inner hole of) the annular reinforcing body. According to this configuration, the linear load which is intensively applied to the corner portion (outer circumferential edge portion) of the bottom portion of the pit main body 18 is received by the reinforcing body, it is possible to prevent a decrease in cold insulation performance generated due to disposition of the reinforcing body which does not have a heat insulation property, and it is possible to increase cold insulation performance of the low-temperature tank 1.

It is possible to provide the above-ground low-temperature tank capable of providing the pump pit while preventing a decrease in cold insulation performance.

While preferred embodiments of the disclosure have been described and illustrated above, it should be understood that these are exemplary of the disclosure and are not to be considered as limiting. Additions, omissions, substitutions, and other modifications can be made without departing from the spirit or scope of the present disclosure. Accordingly, the disclosure is not to be considered as being limited by the foregoing description, and is only limited by the scope of the appended claims.

What is claimed is:

1. An above-ground low-temperature tank, comprising:

a metal inner tank which stores low-temperature liquefied gas; and an outer tank which includes a concrete outer wall surrounding the inner tank, wherein a hole portion which has a preset depth from a bottom surface of the inner tank is formed on a bottom portion of the inner tank, and a metal pit main body having a cylindrical bottomed accommodating portion is provided in a state where the accommodating portion is accommodated in the hole portion, a reinforcing body which supports at least an outer circumferential edge portion of a bottom surface of the pit main body is provided on the bottom surface side of the pit main body in the hole portion, and a cold insulation material is provided below the reinforcing body.

2. The above-ground low-temperature tank according to claim 1, wherein compressed glass wool is disposed outside a side peripheral surface of the pit main body in the hole portion.

3. The above-ground low-temperature tank according to claim 2, wherein the reinforcing body is annularly formed to support the outer circumferential edge portion of the bottom surface of the pit main body, and the cold insulation material is provided inside the annular reinforcing body.

4. The above-ground low-temperature tank according to claim 3, wherein the reinforcing body is made of concrete.

5. The above-ground low-temperature tank according to claim 2, wherein the reinforcing body is made of concrete.

6. The above-ground low-temperature tank according to claim 1, wherein the reinforcing body is annularly formed to support the outer circumferential edge portion of the bottom surface of the pit main body, and the cold insulation material is provided inside the annular reinforcing body.

7. The above-ground low-temperature tank according to claim 6, wherein the reinforcing body is made of concrete.

8. The above-ground low-temperature tank according to claim 1, wherein the reinforcing body is made of concrete.

* * * * *